US009724654B2

(12) United States Patent
Kim et al.

(10) Patent No.: US 9,724,654 B2
(45) Date of Patent: Aug. 8, 2017

(54) AGITATING BAR AND AGITATOR COMPRISING THE SAME

(71) Applicant: LG CHEM, LTD., Seoul (KR)

(72) Inventors: Dae Hun Kim, Daejeon (KR); Kyoung Hoon Min, Daejeon (KR); Ye Hoon Im, Daejeon (KR)

(73) Assignee: LG CHEM, LTD., Seoul (KR)

( * ) Notice: Subject to any disclaimer, the term of this patent is extended or adjusted under 35 U.S.C. 154(b) by 398 days.

(21) Appl. No.: 14/321,949

(22) Filed: Jul. 2, 2014

(65) Prior Publication Data

US 2015/0023134 A1 Jan. 22, 2015

(30) Foreign Application Priority Data

Jul. 19, 2013 (KR) ..... 10-2013-0085592
Jun. 17, 2014 (KR) ..... 10-2014-0073436

(51) Int. Cl.
*B01F 15/00* (2006.01)
*B01F 7/00* (2006.01)
*B01F 7/18* (2006.01)

(52) U.S. Cl.
CPC ..... *B01F 7/0025* (2013.01); *B01F 7/00641* (2013.01); *B01F 7/186* (2013.01); *B01F 15/00915* (2013.01); *B01F 2215/0409* (2013.01)

(58) Field of Classification Search
CPC ..... B01F 7/00641; B01F 2005/0637; B01F 7/00541
See application file for complete search history.

(56) References Cited

U.S. PATENT DOCUMENTS 5,248,485 A * 9/1993 Lilja ..... B01D 19/0052 366/59
6,508,583 B1 1/2003 Shankwitz et al.
2010/0182869 A1 7/2010 Hoefken

FOREIGN PATENT DOCUMENTS

DE 42 18 027 A1 12/1992
JP 1290297 U 10/1978
KR 1020130112491 10/2013

* cited by examiner

*Primary Examiner* — Elizabeth Insler
(74) *Attorney, Agent, or Firm* — Dentons US LLP

(57) ABSTRACT

An agitating bar and an agitator including the same are provided. The agitating bar includes a barrier unit in addition to a rotating shaft, and an impeller unit. Therefore, the agitating bar can be useful in preventing the stream of a fluid which flows rapidly toward a fluid outlet port in a state in which the fluid is not mixed uniformly around the rotating shaft, thereby enhancing agitation efficiency and a degree of homogenization for the mixed fluid.

9 Claims, 6 Drawing Sheets

AGITATING BAR AND AGITATOR COMPRISING THE SAME

CROSS-REFERENCE TO RELATED APPLICATION

This application claims priority to and the benefit of Korean Patent Application No. 10-2014-0073436, filed Jun. 17, 2014 and Korean Patent Application No. 10-2013-0085592, filed Jul. 19, 2013, the disclosure of which is incorporated herein by reference in its entirety.

BACKGROUND

1. Field of the Invention

The present invention relates to an agitating bar and an agitator including the same.

2. Discussion of Related Art

An agitator is a device that uniformly agitates at least two materials having different physical or chemical properties using a rotational force, and has been widely used in various fields such as chemistry, foods, fermentation, and textile industries. Among the materials, when a mixed fluid having a high viscosity is agitated, various types of agitators are typically used. The agitators are mainly divided into tank agitators and flow agitators according to an agitation mode. Among these, the tank agitators have been widely used, and the tank agitators use a device such as an agitating bar to agitate a fluid in an agitation tank, and are classified into various types of propeller-type, oar-type, turbine-type and helix-type tank agitators according to the shapes of blades installed at the agitating bar.

In general, the tank agitators agitate and mix a fluid by rotating a rotating shaft, which has agitation blades installed at the center in an agitation tank, outside the agitation tank to cause spiral, vertically circulating or laminar streams in the mixed fluid flowing in the agitation tank. However, the tank agitators has a problem in that, when a high-viscosity fluid is agitated using the tank agitator, the stream of fluid occurs locally in a laminar stream zone without affecting a vertically circulating stream zone, which makes it difficult to mix the fluid uniformly.

Therefore, the technology of coupling blades or impellers to an agitating bar so as to mix the high-viscosity fluid uniformly was proposed. For the proposed technology, however, when a mixed fluid flows through a fluid inlet port 200 arranged in a lower portion of an agitator as shown in FIG. 1, a stream 100 of the fluid is forced to flow rapidly toward a fluid outlet port 300 in a state in which the high-viscosity fluid is not mixed uniformly around a rotating shaft 1 of the agitating bar, which makes it difficult to mix the high-viscosity fluid uniformly.

Accordingly, there is an increasing demand for agitators capable of agitating a mixed fluid more uniformly by preventing a stream of fluid from occurring around the rotating shaft of the agitating bar and preventing the stream of fluid from flowing rapidly toward the fluid outlet port in a state in which the high-viscosity fluid is not mixed uniformly when the high-viscosity fluid is mixed in the tank agitator.

Korean Unexamined Patent Application Publication No. 2013-0112491 discloses an agitator capable of improving mixing uniformity of a fluid.

SUMMARY OF THE INVENTION

The present invention is directed to providing an agitating bar, and an agitator including the same.

One aspect of the present invention provides an agitating bar including a rotating shaft, an impeller unit formed at the rotating shaft to agitate a fluid, and a barrier unit formed at an upper or lower portion of the impeller unit and having a surface configured to change a stream of the fluid. In this case, the thickness of the barrier unit gets smaller as the barrier unit gets remote from the center of the rotating shaft.

Another aspect of the present invention provides an agitator including an agitation tank having an internal space in which a fluid is agitated, and an agitating bar configured to agitate the fluid in the internal space of the agitation tank. In this case, the agitating bar includes a rotating shaft, an impeller unit formed at the rotating shaft to agitate a fluid, and a barrier unit formed at an upper or lower portion of the rotating shaft having the impeller unit formed therein and having a surface configured to stop a stream of the fluid, and the thickness of the barrier unit gets smaller as the barrier unit gets remote from the center of the rotating shaft.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

Figure 1:
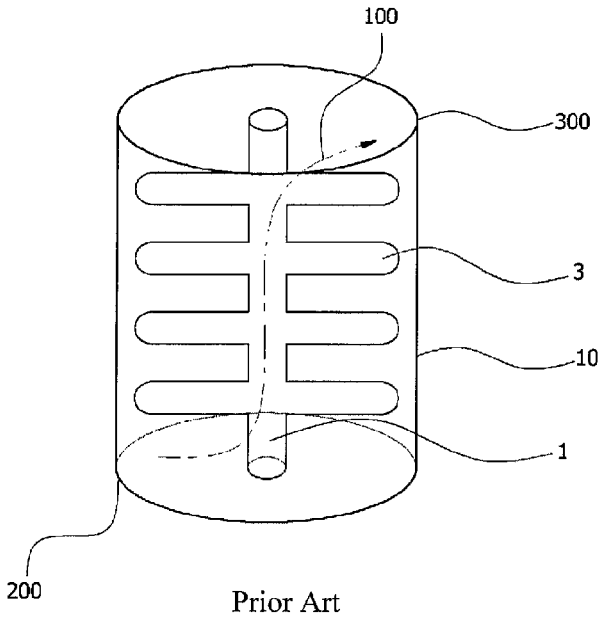
FIG. 1 is a schematic diagram showing a stream in which a mixed fluid introduced into a conventional agitator including an agitating bar flows.

Hereinafter, exemplary embodiments of the present invention will be described in detail. However, the present invention is not limited to the embodiments disclosed below, but can be implemented in various forms. The following embodiments are described in order to enable those of ordinary skill in the art to embody and practice the present invention.

Although the terms first, second, etc. may be used to describe various elements, these elements are not limited by these terms. These terms are only used to distinguish one element from another. For example, a first element could be termed a second element, and, similarly, a second element could be termed a first element, without departing from the scope of exemplary embodiments. The term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of exemplary embodiments. The singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, components and/or groups thereof, but do not preclude the presence or addition of one or more other features, integers, steps, operations, elements, components and/or groups thereof.

With reference to the appended drawings, exemplary embodiments of the present invention will be described in detail below. To aid in understanding the present invention, like numbers refer to like elements throughout the description of the figures, and the description of the same elements will be not reiterated.

Hereinafter, an agitating bar and an agitator according to one exemplary embodiment of the present invention will be described in detail with reference to the accompanying drawings.

First of all, an agitating bar will be described.

The agitating bar according to one exemplary embodiment of the present invention includes a rotating shaft, an impeller unit formed at the rotating shaft to agitate a fluid, and a barrier unit formed at an upper or lower portion of the impeller unit and having a surface configured to change a stream of the fluid.

The rotating shaft is coupled to a drive unit arranged outside an agitation tank to be formed to extend downward, and includes a rotating unit capable of rotating in the agitation tank by rotation of the drive unit. In this case, the rotation direction may be clockwise or counterclockwise.

The rotating shaft may be coupled to the impeller units in the agitation tank.

The impeller unit is a member configured to receive a rotational force of the drive unit to agitate a fluid in the agitation tank, and may include a coupling unit to which the rotating shaft is coupled, and one or more blade units formed to extend from the coupling unit to agitate the fluid. The rotation direction of the impeller unit may be clockwise or counterclockwise as in the rotation direction of the rotating shaft.

Figure 2:
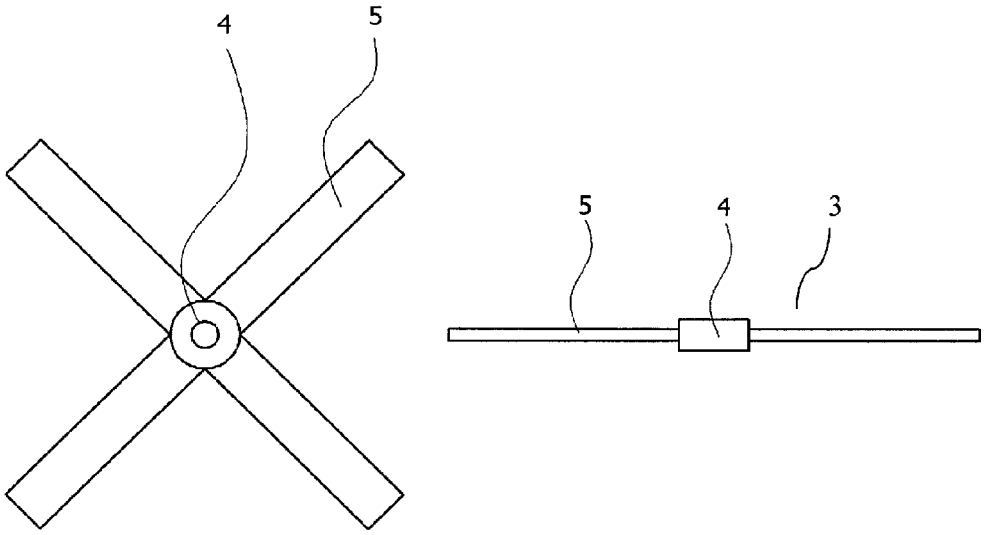
Prior Art FIG. 2
FIG. 2 shows a plane view and a side view of an impeller unit.

As shown in FIG. 2, the plurality of blade units 5 included in the impeller unit 3 may be coupled to the coupling unit 4 of the impeller unit 3 at the same height as the coupling unit 4, thereby further enhancing agitation efficiency.

The blade units of the impeller unit may be formed in the form of a linear rod. In this case, the linear rod may have a rectangular, parallelogrammic, trapezoidal, or circular section, but the present invention is not limited thereto.

The sizes, formation angles and shapes of the blade units included in the impeller unit may be adjusted to enhance fluid agitation efficiency.

Figure 3:
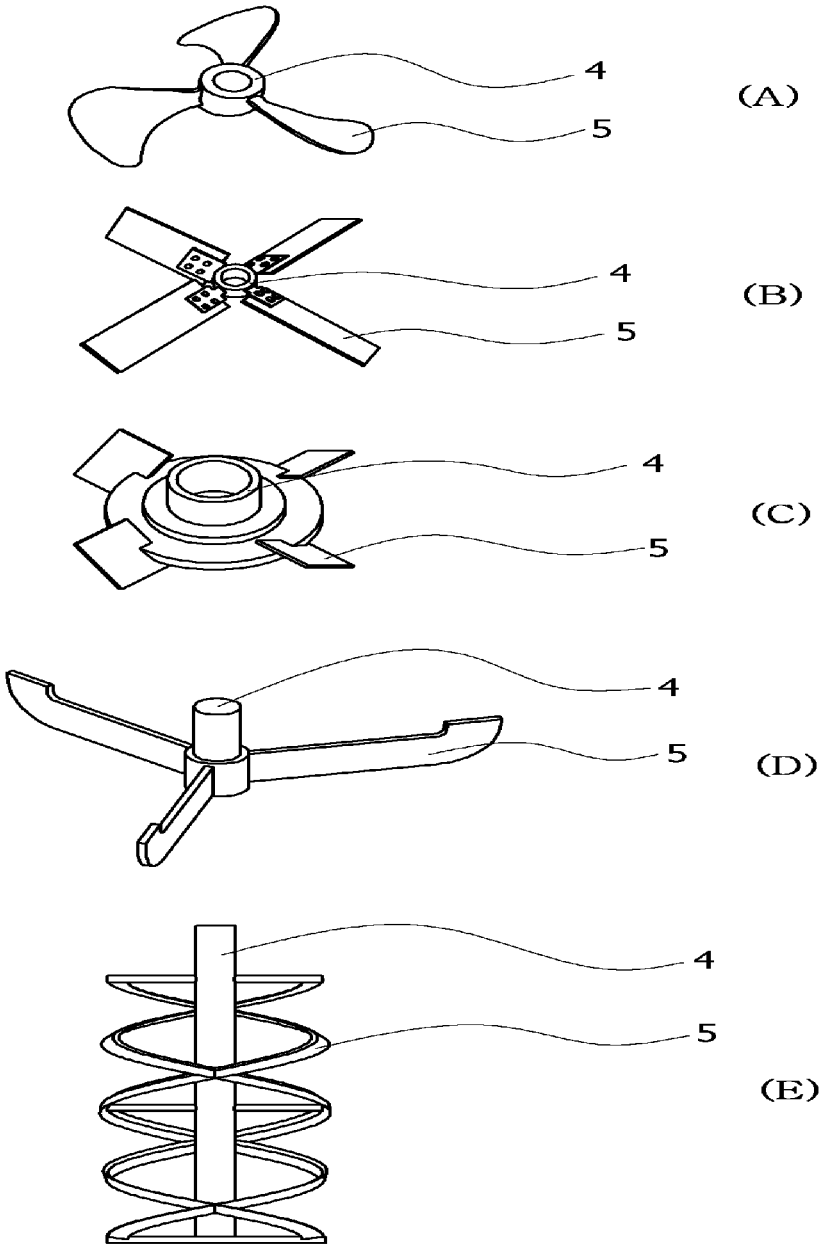
FIG. 3 is a schematic diagram showing various types of the impeller units [(A): propeller-type, (B): paddle-type, (C): turbine-type, (D): anchor-type, and (E): helix-type impeller units]

The types of the blade units 5 included in the impeller units 3 are shown in FIG. 3. The types of the blade units that may be used herein may include a propeller-type blade unit (A), a paddle-type blade unit (B), a turbine-type blade unit (C), an anchor-type blade unit (D), a helix-type blade unit (E), or a mixed-type blade unit. In this case, the blade units may be properly chosen according to the kind and viscosity of the mixed fluid, and the applicable number of rotations may vary according to the types of the blade units.

A plurality of holes may be formed in each of the blade units of the impeller unit. When the impeller unit rotates on the plurality of holes, the overload may be prevented, and the frictional resistance formed between the impeller unit and a material to be agitated may be lowered, thereby enhancing performance of the agitator.

Since the agitation tank may be formed at different depths, the agitation tank may have the two or more impeller units formed along the rotating shaft.

The impeller units may be coupled to the rotating shaft in a state in which the impeller units are perpendicular to the rotating shaft. In this case, the separate impeller units may be maintained at constant intervals. Also, a terminal of each of the impeller units may have such a length so that the terminal can adjoin the inner wall of the agitation tank.

According to one exemplary embodiment, the barrier unit may be formed between the two or more impeller units.

Figure 4:
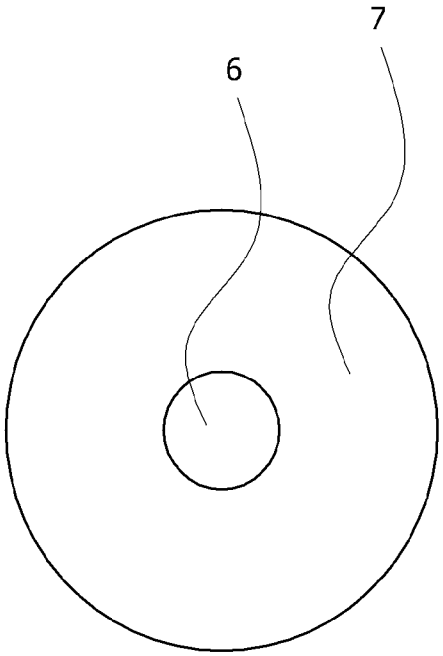
FIG. 4 shows a plane view of a barrier unit.

As shown in FIG. 4, the barrier unit includes a central portion 6 to which the rotating shaft is coupled, and a plate portion 7 formed to extend from the central portion 6 to stop a stream of fluid.

According to one exemplary embodiment, the barrier unit may be configured so that the thickness of the barrier unit gets smaller as the barrier unit gets remote from the center of the rotating shaft.

The barrier unit may satisfy the following Expression 1.

$$0<Y/X\leq 1 \qquad \text{[Expression 1]}$$

Figure 5:
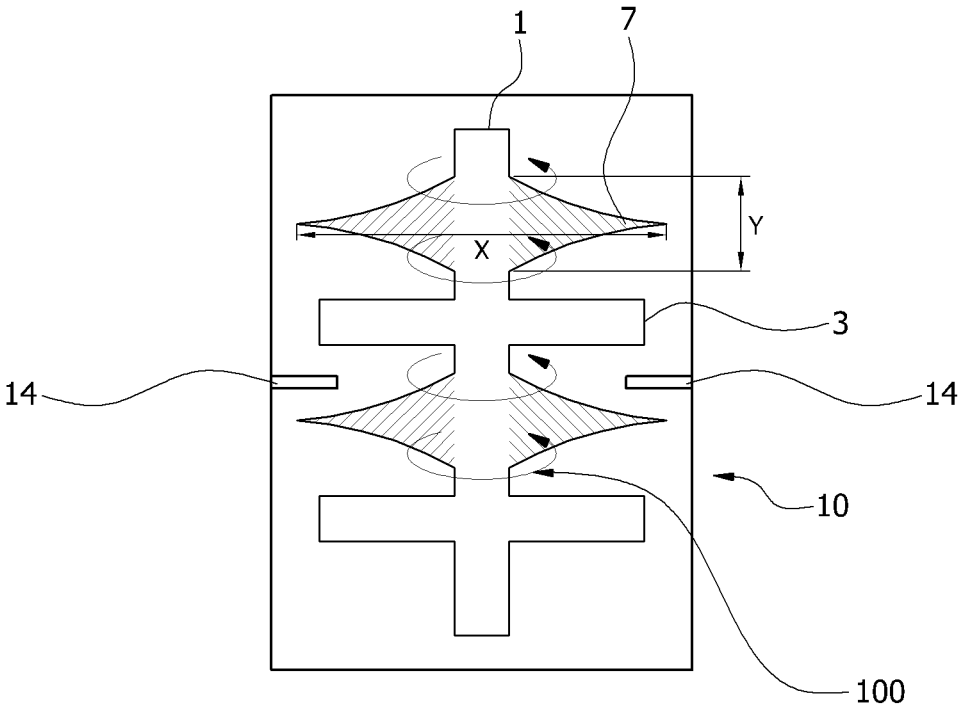
FIG. 5 is a schematic diagram showing a stream in which a mixed fluid introduced into an agitator including an agitating bar according to one exemplary embodiment of the present invention is mixed.

Referring to FIG. 5, in Expression 1, X represents a length of the barrier unit in a horizontal direction with respect to the plate portion, and Y represents a length of the barrier unit in a vertical direction with respect to the central portion.

In Expression 1, when Y is 0, the plate portion of the barrier unit is formed in a planar shape having no thickness. Therefore, it is desirable that the plate portion of the barrier unit have a thickness Y greater than 0, and a Y/X value is less than or equal to 1. Since the agitating bar according to one exemplary embodiment of the present invention may be configured to include the barrier unit having the shape as described above, the agitating bar may stop the stream of fluid which flows rapidly toward a fluid outlet port in a state in which the fluid is not mixed uniformly around the rotating shaft, and cause sufficient mixing of the fluid due to turbulence occurring by rotation of the impeller units coupled to the rotating shaft, thus enhancing agitation efficiency, compared to the conventional agitating bars.

Since the central portion of the barrier unit may be coupled to the rotating shaft, the central portion of the barrier unit may be formed in the same shape as the rotating shaft.

Figure 6:
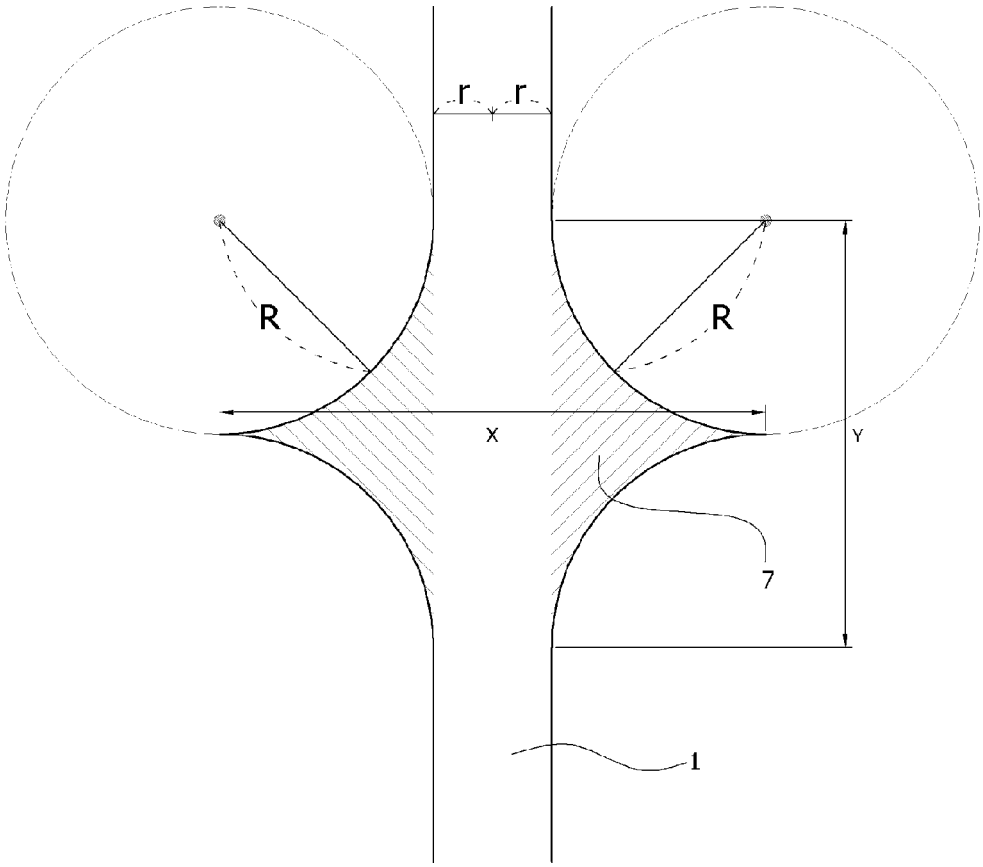
FIG. 6 is a schematic diagram showing the radius of a rotating shaft formed at the agitating bar according to one exemplary embodiment of the present invention and the curvature radius of the barrier unit with respect to a plate portion of the barrier unit.

As shown in FIG. 6, the plate portion of the barrier unit may be in a curved shape. In this case, the curvature radius R with respect to the curved shape may be presented by the following Expression 2.

$$3\times(X/2-r)\leq R \quad \text{[Expression 2]}$$

In Expression 2, X represents a length of the barrier unit in a horizontal direction with respect to the plate portion, and r represents a radius of the rotating shaft in a horizontal direction. When the plate portion of the barrier unit satisfies Expression 2, the ranges of the parameters X, r and R are not particularly limited. For example, X/2 should be necessarily greater than r, and may be properly adjusted according to the size or volume of a reactor.

The shapes of the plate portion of the barrier unit are not particularly limited as long as the plate portion of the barrier unit can be formed in a curved shape. In this case, an upper limit of the curvature radius is not particularly limited. When the plate portion of the barrier unit is in a curved surface having a curvature radius represented by Expression 2, the agitator may stop the stream of fluid which flows rapidly toward the fluid outlet port in a state in which the fluid is not mixed uniformly around the rotating shaft, and cause sufficient mixing of the fluid due to turbulence occurring by rotation of the impeller units coupled to the rotating shaft, thus enhancing agitation efficiency, compared to the conventional agitators.

Hereinafter, the agitator will be described in detail.

Figure 7:
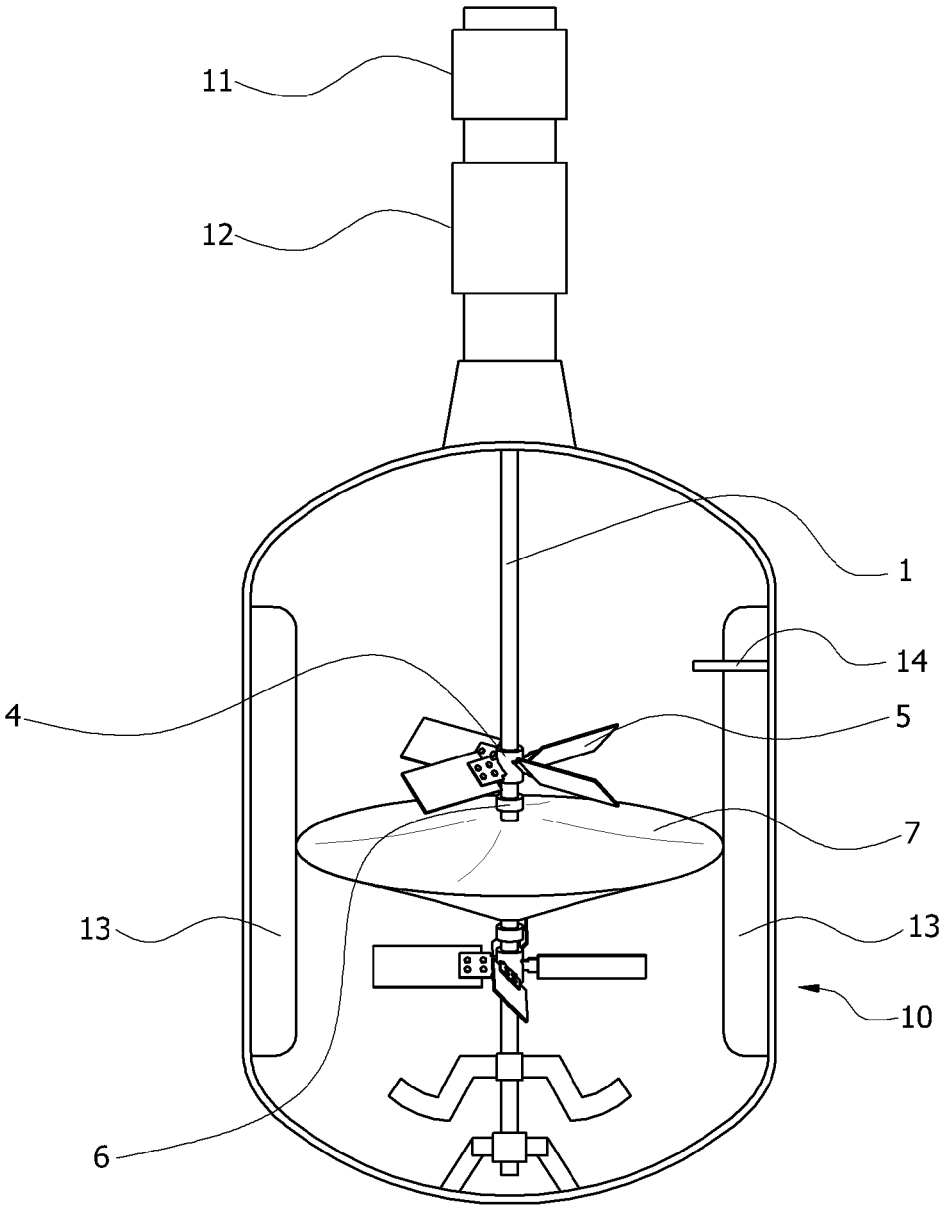
FIG. 7 is a schematic diagram showing an agitator according to one exemplary embodiment of the present invention.

The agitators according to exemplary embodiments of the present invention are shown in FIGS. 5 and 7.

The present invention is directed to an agitator including an agitation tank 10 having an internal space in which a fluid is agitated, and an agitating bar configured to agitate the fluid in the internal space of the agitation tank 10. In this case, the agitating bar includes a rotating shaft 1, an impeller unit 3 formed at the rotating shaft 1 to agitate a fluid, and barrier units having a central portion 6 and a plate portion 7 formed at upper and lower portions of the rotating shaft 1 having the impeller unit 3 formed therein and having a surface configured to stop a stream of the fluid.

Like the conventional agitators, the agitator according to one exemplary embodiment of the present invention is configured to stir and agitate a mixed fluid introduced into the agitation tank by rotating the impeller units coupled to the rotating shaft rotating by means of a motor arranged in the cylindrical agitation tank.

Each of the impeller units may include a coupling unit to which the rotating shaft is coupled, and one or more blade units extending from the coupling unit to agitate a fluid.

The blade units included in the impeller unit may be formed in the form of a linear rod. In this case, the linear rod may have a rectangular, parallelogrammic, trapezoidal, or circular section, but the present invention is not limited thereto.

The sizes, formation angles and shapes of the blade units included in the impeller unit may be adjusted to enhance fluid agitation efficiency.

The types of the blade units that may be used herein may include a propeller-type blade unit, a paddle-type blade unit, a turbine-type blade unit, an anchor-type blade unit, a helix-type blade unit, or a mixed-type blade unit. In this case, the blade units may be properly chosen according to the kind and viscosity of the mixed fluid, and the applicable number of rotations may vary according to the types of the blade units.

The plurality of blade units may be coupled to the coupling unit 4 of the impeller unit at the same height as the coupling unit, thereby further enhancing agitation efficiency.

A plurality of holes may be formed in each of the blade units of the impeller unit. When the impeller unit rotates on the plurality of holes, the overload may be prevented, and the frictional resistance formed between the impeller unit and a material to be agitated may be lowered, thereby enhancing performance of the agitator.

Since the agitation tank may be formed at different depths, the agitation tank may have the two or more impeller units formed along the rotating shaft.

According to one exemplary embodiment, the barrier unit may be formed between the two or more impeller units.

In this case, the barrier unit includes a central portion to which the rotating shaft is coupled, and a plate portion extending from the central portion to stop a stream of fluid.

According to one exemplary embodiment, the barrier unit may be configured so that the thickness of the barrier unit gets smaller as the barrier unit gets remote from the center of the rotating shaft.

The barrier unit may satisfy the following Expression 1.

$$0<Y/X\leq 1 \quad \text{[Expression 1]}$$

Referring to FIG. 5, in Expression 1, X represents a length of the barrier unit in a horizontal direction with respect to the plate portion, and Y represents a length of the barrier unit in a vertical direction with respect to the central portion.

In Expression 1, when Y is 0, the plate portion of the barrier unit is formed in a planar shape having no thickness. Therefore, it is desirable that the plate portion of the barrier unit have a thickness Y greater than 0, and a Y/X value is less than or equal to 1. Since the agitator according to one exemplary embodiment of the present invention may be configured to include the barrier unit having the shape as described above, the agitator may stop the stream of fluid which flows rapidly toward the fluid outlet port in a state in which the fluid is not mixed uniformly around the rotating shaft, and cause sufficient mixing of the fluid due to turbulence occurring by rotation of the impeller units coupled to the rotating shaft, thus enhancing agitation efficiency, compared to the conventional agitating bars.

Since the central portion of the barrier unit may be coupled to the rotating shaft, the central portion of the barrier unit may be formed in the same shape as the rotating shaft.

As shown in FIG. 6, the plate portion of the barrier unit may be in a curved shape. In this case, the curvature radius R with respect to the curved shape may be presented by the following Expression 2.

$$3\times(X/2-r)\leq R \quad \text{[Expression 2]}$$

In Expression 2, X represents a length of the barrier unit in a horizontal direction with respect to the plate portion, and r represents a radius of the rotating shaft in a horizontal direction. When the plate portion of the barrier unit satisfies Expression 2, the ranges of the parameters X, r and R are not particularly limited. For example, X/2 should be necessarily greater than r, and may be properly adjusted according to the size or volume of a reactor.

The shapes of the plate portion of the barrier unit are not particularly limited as long as the plate portion of the barrier unit can be formed in a curved shape. In this case, an upper limit of the curvature radius is not particularly limited. When the plate portion of the barrier unit is in a curved surface having a curvature radius represented by Expression 2, the agitator may stop the stream of fluid which flows rapidly toward the fluid outlet port in a state in which the fluid is not mixed uniformly around the rotating shaft, and cause sufficient mixing of the fluid due to turbulence occurring by rotation of the impeller units coupled to the rotating shaft, thus enhancing agitation efficiency, compared to the conventional agitators.

According to one exemplary embodiment, the agitator may be configured so that a fluid inlet port 200 can be formed at a lower portion of the agitation tank and a fluid outlet port 300 can be formed at an upper portion of the agitation tank, but the present invention is not limited thereto.

As necessary, the agitation tank may have a baffle 14 formed at an inner surface thereof, and the shape of the baffle 14 is not particularly limited, but may include a horizontal baffle shape. In this case, the baffle 14 may be formed in plural numbers, and may be formed at the inner surface of the agitation tank. In this case, the stream of mixed fluid may be changed more widely, thereby further enhancing agitation efficiency.

The temperature may play an important role in agitating a material in the agitation tank. Therefore, a temperature control unit may be provided inside the agitation tank. Also, the inner temperature of the agitator may be controlled according to the kind of the mixed fluid, but the present invention is not limited thereto. For example, a proper control unit such as a steam heater may be installed at an inner or outer wall of the agitation tank so as to maintain the constant inner temperature of the agitation tank.

Also, a bumper plate 13 may be provided at the inner wall of the agitation tank.

The bumper plate 13 may serve to prevent an accompanying concentric-vortex flow which may occur in the agitation tank.

According to one exemplary embodiment, the agitator may include a drive unit 11 configured to provide a rotational force to rotate the agitating bar, and a drive shaft 12 configured to deliver the rotational force of the drive unit 11 to the agitating bar.

The drive unit 11 may include a motor configured to create revolutions as an original power generation source, and a decelerator configured to control the revolutions. The type of the motor that may be used herein may include a totally-enclosed-type motor, an increased-safety explosion-proof motor, a pressure-resistant explosion-proof motor, a pole-changing motor, a high-efficiency motor, an inverter-type motor, or a mixed-type motor, but the present invention is not particularly limited thereto. Also, the type of the decelerator that may be used herein may include a helical gear-type decelerator, a worm gear-type decelerator, a cyclo-type decelerator, a V-belt-type decelerator, a motor direct drive-type decelerator, a variable speed gear-type decelerator, or the like, but the present invention is not particularly limited thereto.

The drive unit provides the revolutions of the motor to the proper impeller unit according to an agitation purpose.

Also, the drive shaft may play a role in delivering the revolutions of the drive unit to the rotating shaft. The drive shaft may be supported by a bearing housing including bearings, a bearing box, and a cover, as necessary.

Hereinafter, the present invention will be described in further detail with reference to Example according to the present invention and Comparative Example not according to the present invention, but it should be understood that the Example and Comparative Example described below are not intended to limit the scope of the present invention.

EXAMPLE 1

To measure of levels of homogenization by means of the agitating bar according to one exemplary embodiment of the present invention and the agitator including the same, that is, an agitating bar including a rotating shaft 1, a plurality of impeller units formed at the rotating shaft to agitate a fluid and a barrier unit formed between the plurality of impeller units and having a surface configured to change a stream of fluid, an agitator including the same, simulations were performed, as follows.

On the assumption that a mixed fluid is introduced into the agitator through the fluid inlet port arranged at a lower portion of the agitator including the agitating bar, when the mixed fluid introduced by rotation of the agitating bar is agitated, the flow field of the mixed fluid was analyzed through numerical simulations.

Also, the paths of the mixed fluid were calculated using a path tracking method. The analysis of the paths calculated thus is shown in FIG. 8.

Figure 8:
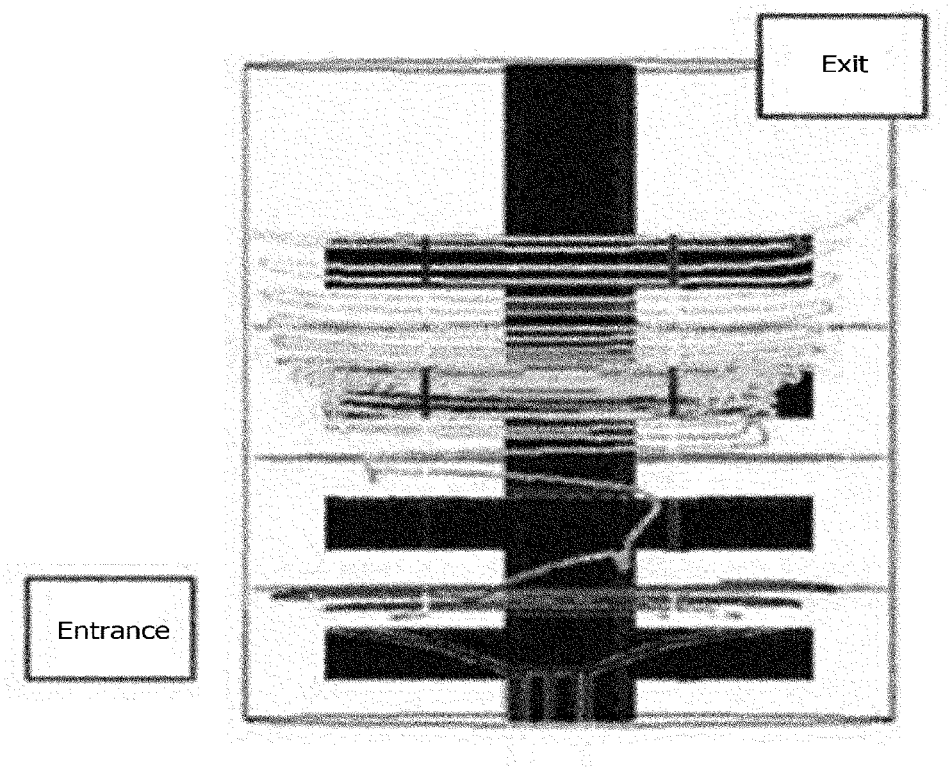
FIG. 8 is a diagram showing the path of a mixed fluid analyzed according to Example 1 of the present invention.

Based on the analyzed paths, it was confirmed that, when the mixed fluid introduced through the fluid inlet port is agitated in the agitator according to one exemplary embodiment of the present invention, the mixed fluid was thoroughly mixed due to the turbulence occurring by rotation of the impeller unit around the barrier unit while forcing the mixed fluid to flow from the fluid inlet port toward the fluid outlet port, as shown in FIG. 8.

To examine the level of the homogenization of the mixed fluid in the agitator more thoroughly, functions of deformation tensor magnitudes of the plurality of paths were integrated again, and the integrated values for the respective paths were compared and analyzed to measure the levels of homogenization of the mixed fluid agitated in the agitator. The graph of the levels of homogenization is shown in FIG. 9 (indicated by "A").

COMPARATIVE EXAMPLE 1

To readily compare the levels of homogenization of the agitator according to one exemplary embodiment of the present invention and the conventional agitator, the levels of homogenization of the mixed fluid introduced into the agitator were measured in the same manner as in Example 1 using the conventional agitator, that is, an agitator including an agitating bar having only the impeller units formed therein. The graph of the levels of homogenization of the mixed fluid is shown in FIG. 9 (indicated by "B").

Figure 9:
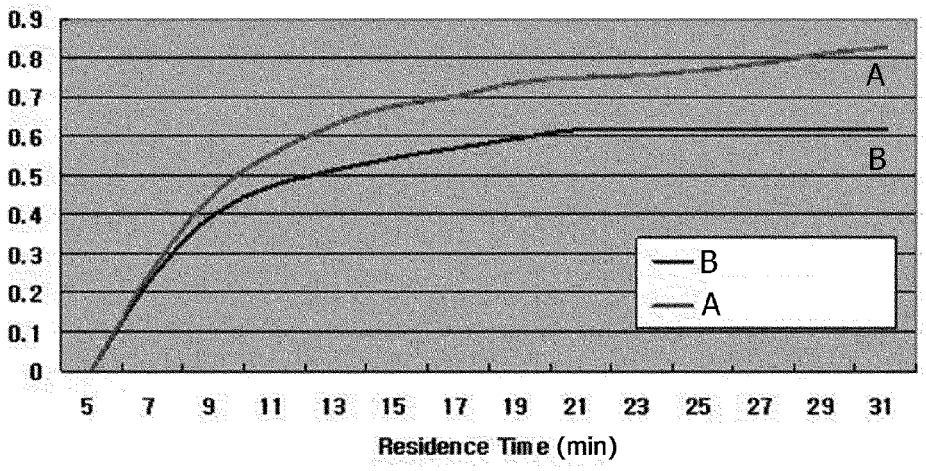
FIG. 9 is a graph showing the degrees of homogenization in respective agitators according to Example 1 and one Comparative Example 1 of the present invention [A represents a degree of homogenization in the agitator according to Example 1 of the present invention, and B represents a degree of homogenization in the agitator according to Comparative Example 1 of the present invention].

As shown in FIG. 9, it could be seen that when the agitator according to one exemplary embodiment of the present invention including the agitating bar including the barrier unit was used, the level of homogenization of the mixed fluid introduced into the agitator further increased with time, compared to the conventional agitator, thereby improving the agitation efficiency.

The agitating bar according to one exemplary embodiment of the present invention includes a barrier unit having a surface configured to change the stream of fluid in addition to the rotating shaft and the impeller unit. Therefore, when a high-viscosity fluid is agitated in the tank agitator, the agitating bar can be useful in preventing the stream of fluid which flows rapidly toward a fluid outlet port in a state in which the fluid is not mixed uniformly around the rotating shaft, thereby enhancing agitation efficiency and a degree of homogenization for the mixed fluid.

While the invention has been shown and described with reference to certain exemplary embodiments thereof, it will be understood by those skilled in the art that various changes in form and details may be made therein without departing from the scope of the invention as defined by the appended claims.

What is claimed is:

1. An agitating bar comprising:

a rotating shaft;

two or more impeller units along the rotating shaft to agitate a fluid, each impeller unit comprising:

a coupling unit to which the rotating shaft is coupled; and one or more blade units extending from the coupling unit to agitate the fluid; and a barrier unit formed between the two or more impeller units, the barrier unit comprising:

a central portion to which the rotating shaft is coupled; and a plate portion formed to extend from the central portion and having a length in the horizontal direction greater than a length of the blade units of the two or more impeller units to stop the flow of a stream of fluid to cause mixing of the stream of fluid due to the impeller units, wherein the thickness of the barrier unit gets smaller as the barrier unit gets remote from the center of the rotating shaft; and the plate portion of the barrier unit has a curvature radius R represented by the following Expression 2:

$$3\times(X/2-r)\leq R \quad \text{[Expression 2]}$$

wherein X represents a length of the barrier unit in a horizontal direction with respect to the plate portion, and r represents a radius of the rotating shaft in a horizontal direction.

2. The agitating bar of claim 1, wherein the impeller unit comprises propeller-type, paddle-type, turbine-type, anchor-type, helix-type, or mixed-type blade units.

3. The agitating bar of claim 1, wherein the barrier unit satisfies the following Expression 1:

$$0<Y/X\leq 1 \quad \text{[Expression 1]}$$

wherein X represents a length of the barrier unit in a horizontal direction with respect to the plate portion, and Y represents a length of the barrier unit in a vertical direction with respect to the central portion.

4. An agitator comprising:

an agitation tank having an internal space in which a fluid is agitated; and an agitating bar configured to agitate the fluid in the internal space of the agitation tank, wherein the agitating bar comprises:

a rotating shaft;

two or more impeller units along the rotating shaft to agitate a fluid, each impeller unit comprising:

a coupling unit to which the rotating shaft is coupled; and one or more blade units extending from the coupling unit to agitate the fluid; and a barrier unit formed between the two or more impeller units, the barrier unit comprising:

a central portion to which the rotating shaft is coupled; and a plate portion formed to extend from the central portion and having a length in the horizontal direction greater than a length of the blade units of the two or more impeller units to stop the flow of a stream of fluid to cause mixing of the stream of fluid due to the impeller units, wherein the thickness of the barrier unit gets smaller as the barrier unit gets remote from the center of the rotating shaft; and the plate portion of the barrier unit has a curvature radius R represented by the following Expression 2:

$$3\times(X/2-r)\leq R \quad \text{[Expression 2]}$$

wherein X represents a length of the barrier unit in a horizontal direction with respect to the plate portion, and r represents a radius of the rotating shaft in a horizontal direction.

5. The agitator of claim 4, wherein the impeller unit comprises propeller-type, paddle-type, turbine-type, anchor-type, helix-type, or mixed-type blade units.

6. The agitator of claim 4, wherein the barrier unit satisfies the following Expression 1:

$$0<Y/X\leq 1 \quad \text{[Expression 1]}$$

wherein X represents a length of the barrier unit in a horizontal direction with respect to the plate portion, and Y represents a length of the barrier unit in a vertical direction with respect to the central portion.

7. The agitator of claim 4, wherein the agitation tank has a fluid inlet port and a fluid outlet port formed at lower and upper portion thereof, respectively.

8. The agitator of claim 4, wherein the agitation tank has a baffle on an inner surface thereof.

9. The agitator of claim 4, further comprising:

a drive unit configured to provide a rotational force to rotate the agitating bar; and a drive shaft configured to deliver the rotational force of the drive unit to the agitating bar.

* * * * *